US005164747A

United States Patent [19]

Osada et al.

[11] Patent Number: 5,164,747

[45] Date of Patent: Nov. 17, 1992

[54] INK JET HEAD WITH TESTING RESISTORS

[75] Inventors: Torachika Osada, Kawasaki; Toshiaki Hirosawa, Hiratsuka; Jiro Moriyama, Yokohama; Hidemi Kubota, Komae; Yutaka Koizumi; Mineo Kaneko, both of Tokyo, all of Japan

[73] Assignee: Canon Kabushiki Kaisha, Tokyo, Japan

[21] Appl. No.: 636,098

[22] Filed: Dec. 31, 1990

[30] Foreign Application Priority Data

Dec. 29, 1989 [JP] Japan ..... 1-344929

[51] Int. Cl.[5] ..... B41J 2/05

[52] U.S. Cl. ..... 346/140 R; 29/593; 324/537; 346/1.1

[58] Field of Search ..... 346/140, 76 PH; 29/593; 324/537, 538, 525, 527, 718

[56] References Cited

U.S. PATENT DOCUMENTS

| | | | |
|---|---|---|---|
| 2,493,524 | 1/1950 | Bruns | 324/525 |
| 3,345,262 | 8/1982 | Shirato et al. . | |
| 4,313,124 | 1/1982 | Hara . | |
| 4,459,600 | 7/1984 | Sato et al. . | |
| 4,463,359 | 7/1984 | Ayata et al. . | |
| 4,558,333 | 12/1985 | Sugitani et al. . | |
| 4,723,129 | 2/1988 | Endo et al. . | |
| 4,740,796 | 4/1988 | Endo et al. . | |
| 4,835,466 | 5/1989 | Maly | 324/718 X |
| 4,996,487 | 2/1991 | McSparran | 346/140 X |

FOREIGN PATENT DOCUMENTS

| | | |
|---|---|---|
| 0314388 | 5/1989 | European Pat. Off. . |
| 0344809 | 12/1989 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 2203384 | 10/1988 | United Kingdom . |

*Primary Examiner*—Joseph W. Hartary
*Attorney, Agent, or Firm*—Fitzpatrick, Cella, Harper & Scinto

[57] ABSTRACT

An ink jet head is provided with testing or inspection to facilitate efficient testing of the circuitry to determine whether any short-circuit or open circuits exist.

The ink jet head includes plural ejection outlets for ejecting ink; a corresponding number of heat generating resistors disposed corresponding to the ejection outlets; heat generating resistors corresponding to the ejection outlets; electrodes connected to the respective heat generating resistors. The inspection resistors connect adjacent electrodes to permit inspection of electric connections.

20 Claims, 8 Drawing Sheets

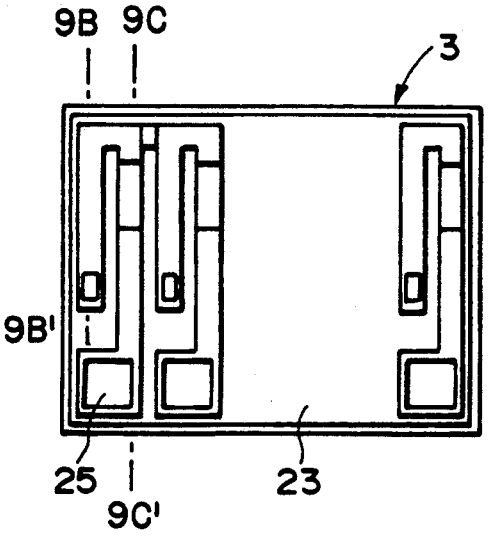
FIG. 9A
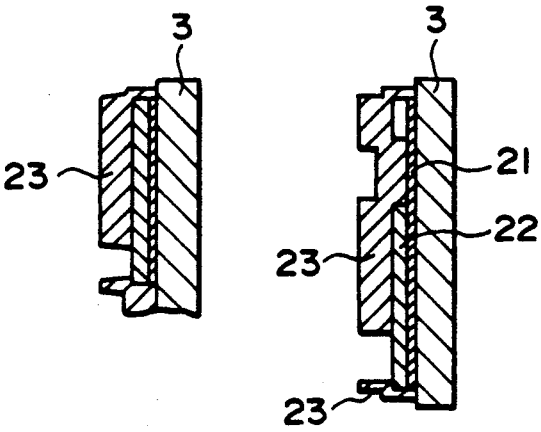
FIG. 9B
FIG. 9C
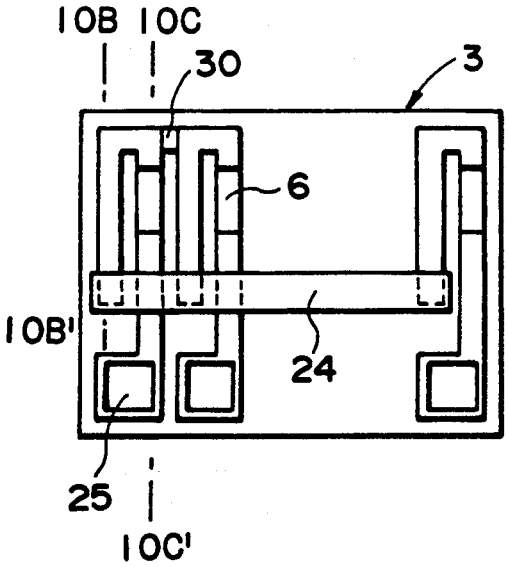
FIG. 10A
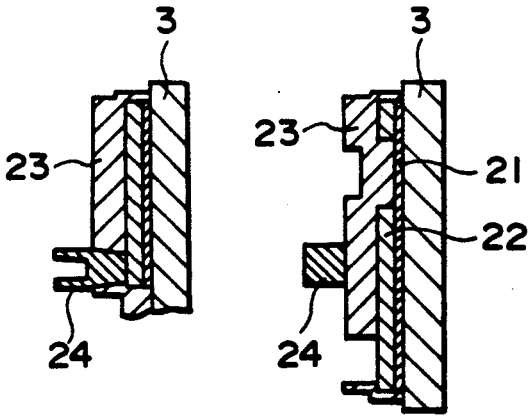
FIG. 10B
FIG. 10C

INK JET HEAD WITH TESTING RESISTORS

FIELD OF THE INVENTION AND RELATED ART

The present invention relates to an ink jet recording head, a manufacturing method thereof, an ink jet recording head substrate, an inspection method therefor and an ink jet recording apparatus, more particularly to such devices and methods wherein a number of electrothermal transducers are formed on a substrate corresponding to respective ejection outlets covering one line of record.

In an ink jet recording apparatus, droplets of ink are formed through various methods and are deposited on a recording material. Among various systems, an ink jet recording apparatus using thermal energy for ejecting the ink is advantageous because the ejection outlets may be easily arranged at a high density, and because high resolution and high quality images can be provided at a high speed. It has a number of energy generating means for generating thermal energy contributable to eject the liquid droplets through ejection outlets. It may be in the form of an electrothermal transducers supplied with electric energy to generate heat to heat the ink. In some cases, the electrothermal transducers and a driving IC for driving the electrothermal transducers are formed on the same substrate.

FIG. 1 is an enlarged top plan view of such a substrate of an ink jet recording head. On this substrate, a number of electrothermal transducers corresponding to the ejection outlets are formed on the substrate. During the recording operation, the recording head having the ejection outlets is stationary (full-line head). In this Figure, reference numeral 101 designates a head supporting plate; 102 designates a heat generating portion of a heat generating resistor; 103 designates electric wiring (electrodes) for supplying electric pulses to the heat generating portion of the heat generating resistor; 104 designates pads formed at ends of the electric wiring 103. The pads 104 have been used mainly for the purpose of inspection of the wiring (short circuit and disconnection). During the manufacturing, an inspection step is carried out to check the disconnection and short circuit of the wiring. If the short circuit is discovered, the point of short circuit is cut by a laser beam. By doing so, the substrate becomes usable, which otherwise would have been rejected. In such inspection, probe pins are contacted to the pads 104 made of aluminum or the like, and therefore, the pads 104 each have a relative area, for example, 100×100 microns.

SUMMARY OF THE INVENTION

In the conventional recording head, the pads 104 occupy relatively large areas, as discussed above, and therefore, the wiring pattern becomes as shown in FIG. 1. With the increase of the length of the full-line recording head and the increase in the recording density (400 dpi, for example), the supporting plate 101 becomes larger with the result of increased cost. An additional disadvantage is the complicated structure of the wiring pattern. Accordingly, it is a principal object of the present invention to provide an ink jet recording head wherein the wiring pattern is simple.

It is another object of the present invention to provide an ink jet recording head having a supporting plate which is not very large because of simple arrangements of contact pads.

It is a further object of the present invention to provide an ink jet recording head wherein the wiring checking operation is easy.

It is a further object of the present invention to provide a manufacturing method of such a recording head.

It is a further object of the present invention to provide an ink jet recording head substrate usable with such a recording head.

It is a further object of the present invention to provide an inspection method for such an ink jet recording head substrate.

It is a further object of the present invention to provide an ink jet recording apparatus using such method, such substrate and/or such inspection method.

According to an aspect of the present invention, there is provided an ink jet head, comprising: plural ejection outlets for ejecting ink; a corresponding number of heat generating resistors disposed corresponding to said ejection outlets; heat generating resistors corresponding to said ejection outlets; electrodes connected to the respective heat generating resistors; and inspection resistors connecting adjacent ones of said electrodes for permitting inspection relating to electric connection.

According to another aspect of the present invention, there is provided a substrate for an ink jet head, comprising: plural ejection outlets for ejecting ink; a corresponding number of heat generating resistors disposed corresponding to said ejection outlets; heat generating resistors corresponding to said ejection outlets; electrodes connected to the respective heat generating resistors; and inspection resistors connecting adjacent ones of said electrodes for permitting inspection relating to electric connection.

According to a further aspect of the present invention, there is provided an ink jet apparatus, comprising: an ink jet head, comprising plural ejection outlets for ejecting ink; a corresponding number of heat generating resistors disposed corresponding to said ejection outlets; heat generating resistors corresponding to said ejection outlets; electrodes connected to the respective heat generating resistors; inspection resistors connecting adjacent ones of said electrodes for permitting inspection relating to electric connection; and feeding means for feeding a recording material on which said ejection outlets eject the ink.

According to a further aspect of the present invention, there is provided a method of inspecting an ink jet head, comprising: providing an ink jet head, comprising plural ejection outlets for ejecting ink; a corresponding number of heat generating resistors disposed corresponding to said ejection outlets; heat generating resistors corresponding to said ejection outlets; electrodes connected to the respective heat generating resistors; inspection resistors connecting adjacent ones of said electrodes for permitting inspection of electric connection; and detecting electric resistance between electrodes connected by said inspection resistor to inspect electric connection.

According to a yet further object of the present invention, there is provided a method of manufacturing an ink jet recording head, comprising: providing an ink jet head comprising plural ejection outlets for ejecting ink; a corresponding number of heat generating resistors disposed corresponding to said ejection outlets; heat generating resistors corresponding to said ejection outlets; electrodes connected to the respective heat generating resistors; inspection resistors connecting adjacent ones of said electrodes for permitting inspection of electric connection; detecting electric resistance between electrodes connected by said inspection resistor to inspect electric connection; and forming ink passages on said ink jet recording head.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
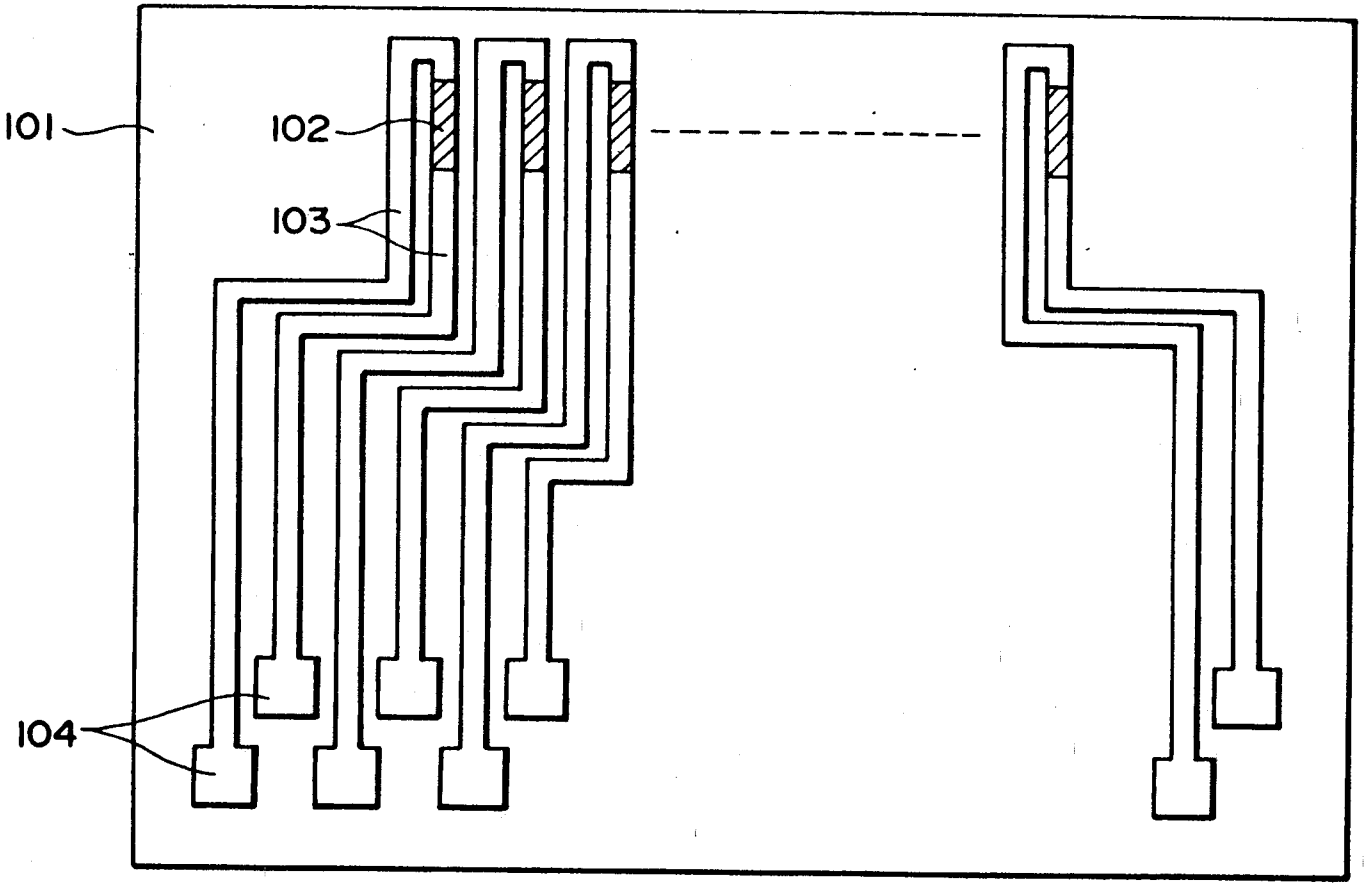
FIG. 1 PRIOR ART
FIG. 1 illustrates a conventional wiring on a supporting plate of an ink jet recording head.
Figure 2:
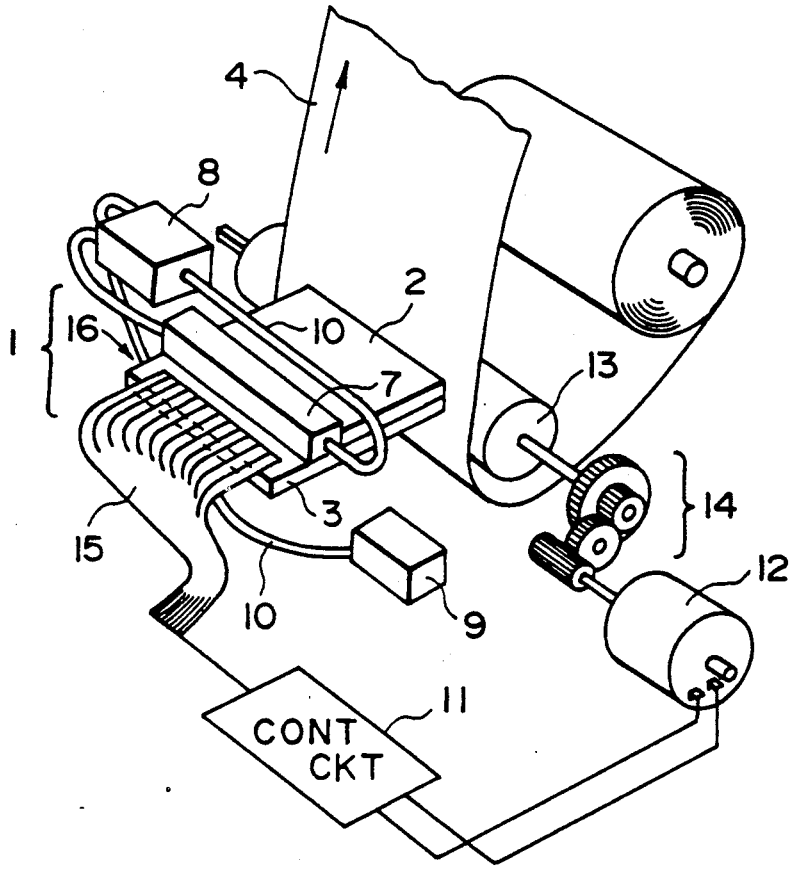
FIG. 2 PRIOR ART
FIG. 2 is a perspective view of a major part of an ink jet recording apparatus according to an embodiment of the present invention.
Figure 3:
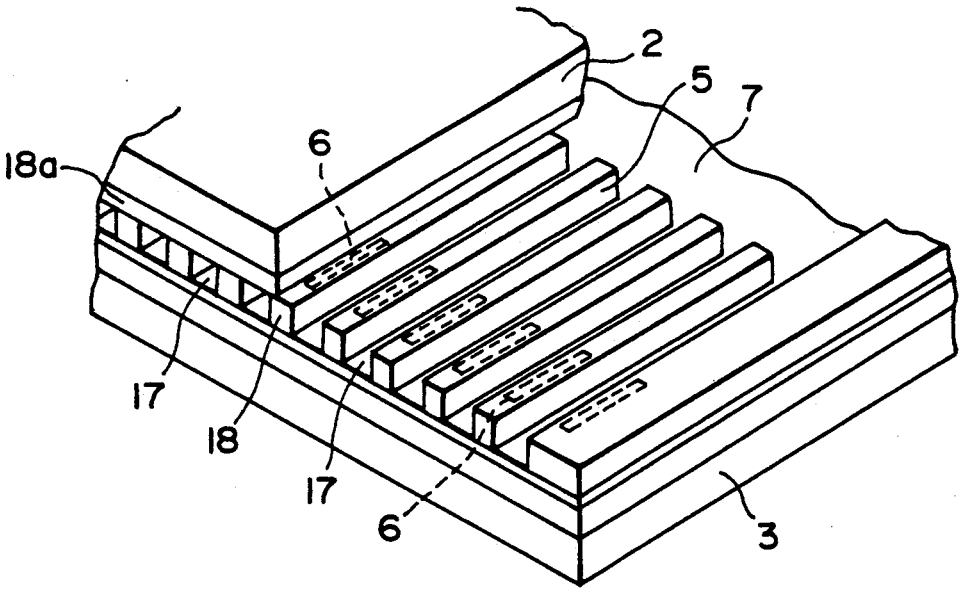
FIG. 3 PRIOR ART
FIG. 3 is a partial perspective view of an ink jet recording head according to an embodiment of the present invention.

Referring to FIG. 2, there is shown a major part of an ink jet recording apparatus having an ink jet recording head according to an embodiment of the present invention. The recording apparatus comprises an ink jet recording head 1, top and supporting plates 2 and 3 constituting the recording head 1, parallel liquid passages 5 covering the entire recording width for a recording sheet 4 (FIG. 3), and heat generating portions of electrothermal transducers. The liquid passages 5 are supplied with ink from a common ink chamber 7. An intermediate container is disposed between a main container 9 across a supply tube 10. Recording sheet feeding means comprises a motor 12 functioning as a driving means controlled by a control circuit 11, a platen 13 rotated by a motor 12 to feed the recording sheet 4, and a gear train 14 for transmitting rotation from the motor 14 to the platen 13. A flexible cable 15 functions to supply the recording signals from the control circuit 11 to the recording head 1. An electric connector 16 for electrically connecting the flexible cable 15 to the supporting plate 3 relates to an aspect of the present invention, which will be described in detail hereinafter.

Referring back to FIG. 3, ink ejection outlets 17 are arranged to cover the entire width of the recording sheet and are formed at an end of the liquid passages 5. The ink ejection outlet 17 and the liquid passage 5 are constituted by walls 18 extending from the supporting plate 3. A bonding agent layer **18*a* is used for bonding the top plate 2**.

Figure 4:
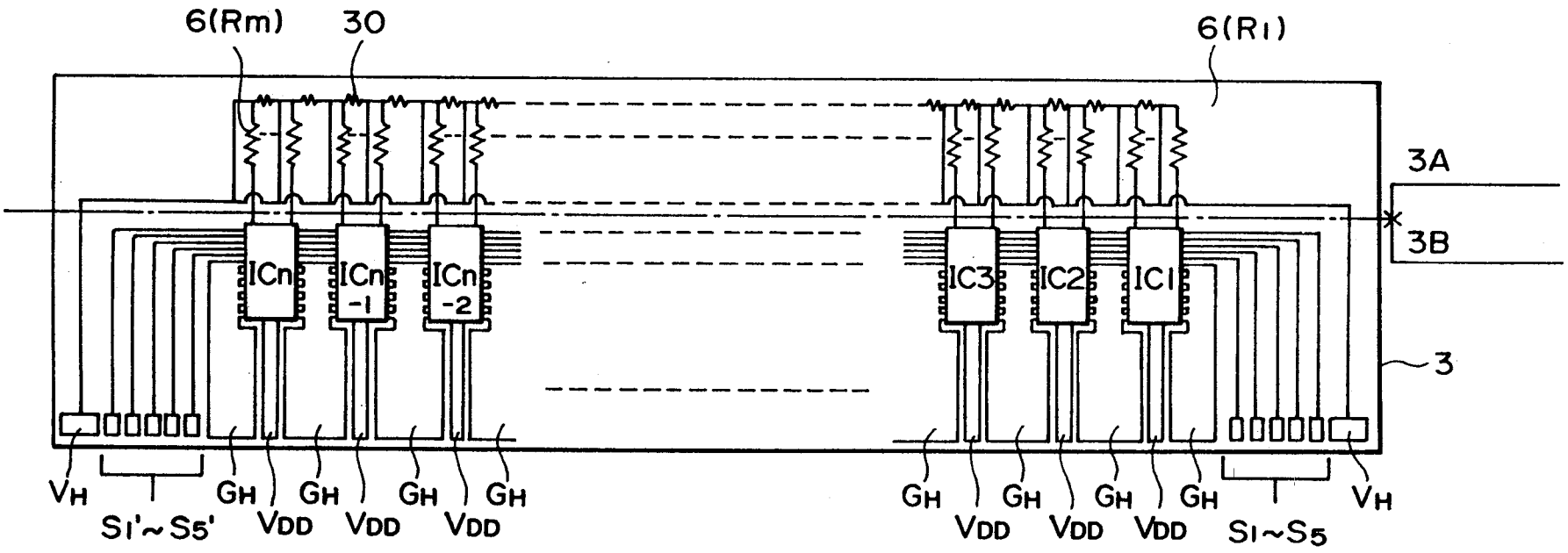
FIG. 4 shows wiring on an ink jet recording head supporting plate of FIG. 3.
Figure 5A:
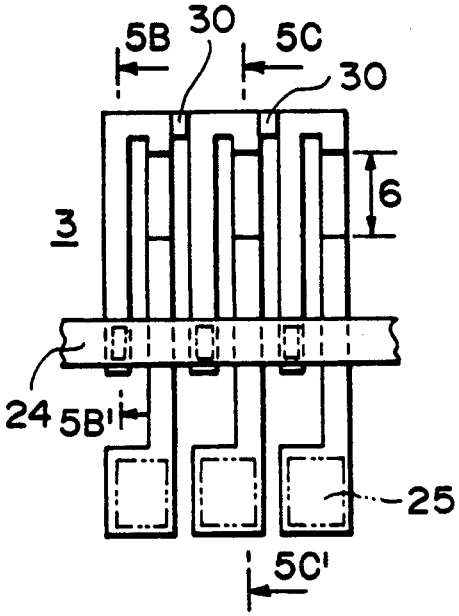
FIG. 5A is a partial top plan view of a multi-layer circuit substrate for an ink jet recording head according to an embodiment of the present invention.
Figure 5B:
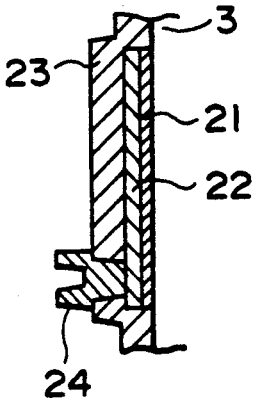
FIGS. 5B and 5C are sectional views taken along line 5B—5B' and a line 5C—5C', respectively of FIG. 5A.
Figure 5C:
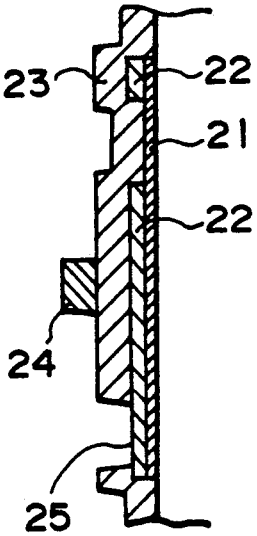

Referring to FIG. 4, the description will be made as to the structure of the wiring formed on the supporting plate 3 of the ink jet recording head 1. The top part defined by a chain line is a multi-layer circuit substrate portion 3A in which heat generating portions 6 (R1-Rm) of the heat generating resistors manufactured through the process which is similar to a semiconductor manufacturing process. The part below the chain line is a switching element portion 3B. In the switching element portion 3B, there are common electrodes VH for applying a voltage to a heat generating portion of a heat generating resistor 6 (R1-Rm). Also, there are signal lines S1-S5 and S1'-S5' having I/O contacts at an end of the head supporting plate 3 and juxtaposed at a side of driving ICs (IC1-ICn). Through the signal lines, various signals are transmitted, such as recording data, signal transmitting clock signals, latching signals, strobe signals for divided-driving for the ICs or transmission clock signals for the divided-driving for the ICs. Additionally, there are grounding semiconductor terminals GH for the recording current, disposed at both sides for the driving ICs. Between the GH contacts, contacts for applying a driving voltage VDD for driving the driving ICs (IC1-ICn). FIGS. 5A, 5B and 5C illustrate in an enlarges scale a multi-layer circuit substrate 3A, and are a top plan view, a sectional view taking along a line 5B—5B' of FIG. 5A, and a sectional view taken along line 5C—5C' of FIG. 5A, respectively. In these Figures, reference numeral 21 designates a heat generatig resistor layer constituting a heat generating portion 6; 22 designates an electric line made of aluminum connected to the heat generating portion 6 of the heat generating resistor; 23 designates an insulating film for protecting the heat generating portion 6 and the line 22; and 24 designates the common electrode for applying the recording voltage to the heat generating portion 6. A contact pad 25 is for connection with the switching element portion 3B and also for inspection for open-short-circuit of the lines 22. An inspection or testing resistor 30 connects adjacent lines 22. The function of the inspection resistors 30 will be described hereinafter.

Referring to FIGS. 6, 7, 8, 9 and 10, the manufacturing method for the multi-layer circuit substrate for the ink jet recording head.

Figure 6A:
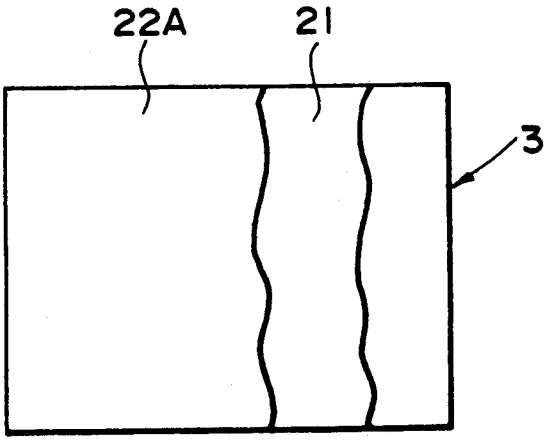
FIGS. 6A', 6B', 7A', 7B', 7C'; 8A', 8B', 8C'; 9A', 9B', 9C'; and 10A', and 10B' and 10C' illustrate manufacturing steps for the multi-layer circuit substrate in top plan views and cross-sections.
Figure 6B:
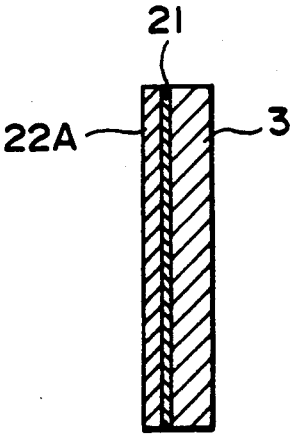
Figure 7A:
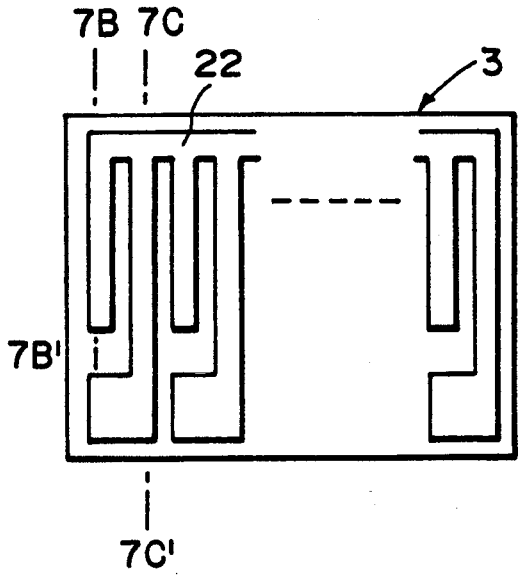
Figure 7B:
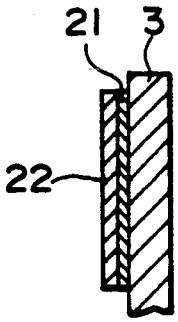
Figure 7C:
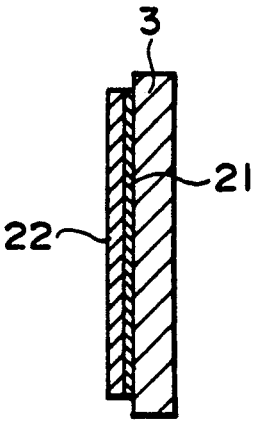
Figure 8A:
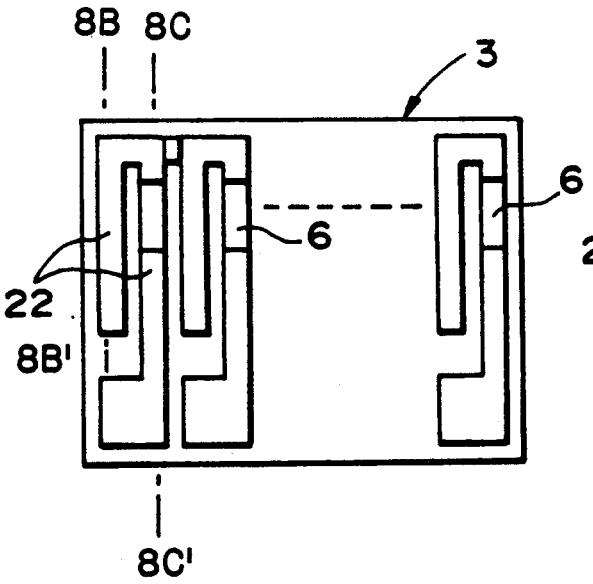
Figure 8B:
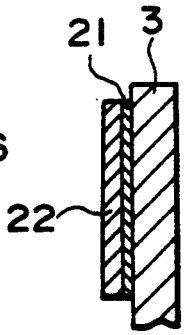
Figure 8C:
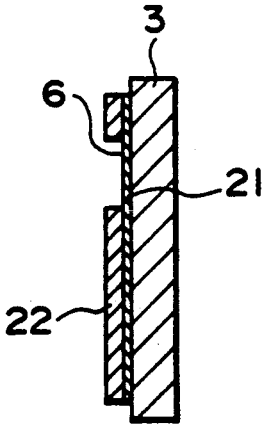

First, as shown in FIGS. 6A and 6B, a heat generating resistor layer 21 of $HfB_2$ is formed by sputtering on the supporting plate 3 made of Si plate having a $SiO_2$ film (heat oxidation). On the heat generating resistor layer 21, an aluminum layer 22A constituting wiring is laminated by sputtering. Second, a pattern shown in FIGS. 7A, 7B and 7C is formed by a patterning using photolithography. Third, the heat generating portions 6 and the inspection resistor 30 are formed as shown in FIGS. 8A–8C by the patterning using photolithography. Fourth, an insulating film ($SiO_2$) for protecting the aluminum wiring 22 and the heat generating portion 6 is laminated as shown in FIGS. 9A, 9B and 9C. Fifth, as shown in FIGS. 10A, 10B and 10C, the common electrodes 24 are formed by Al plating.

Thus, the laminated circuit substrate 3A is formed on the supporting plate 3.

Figure 11:
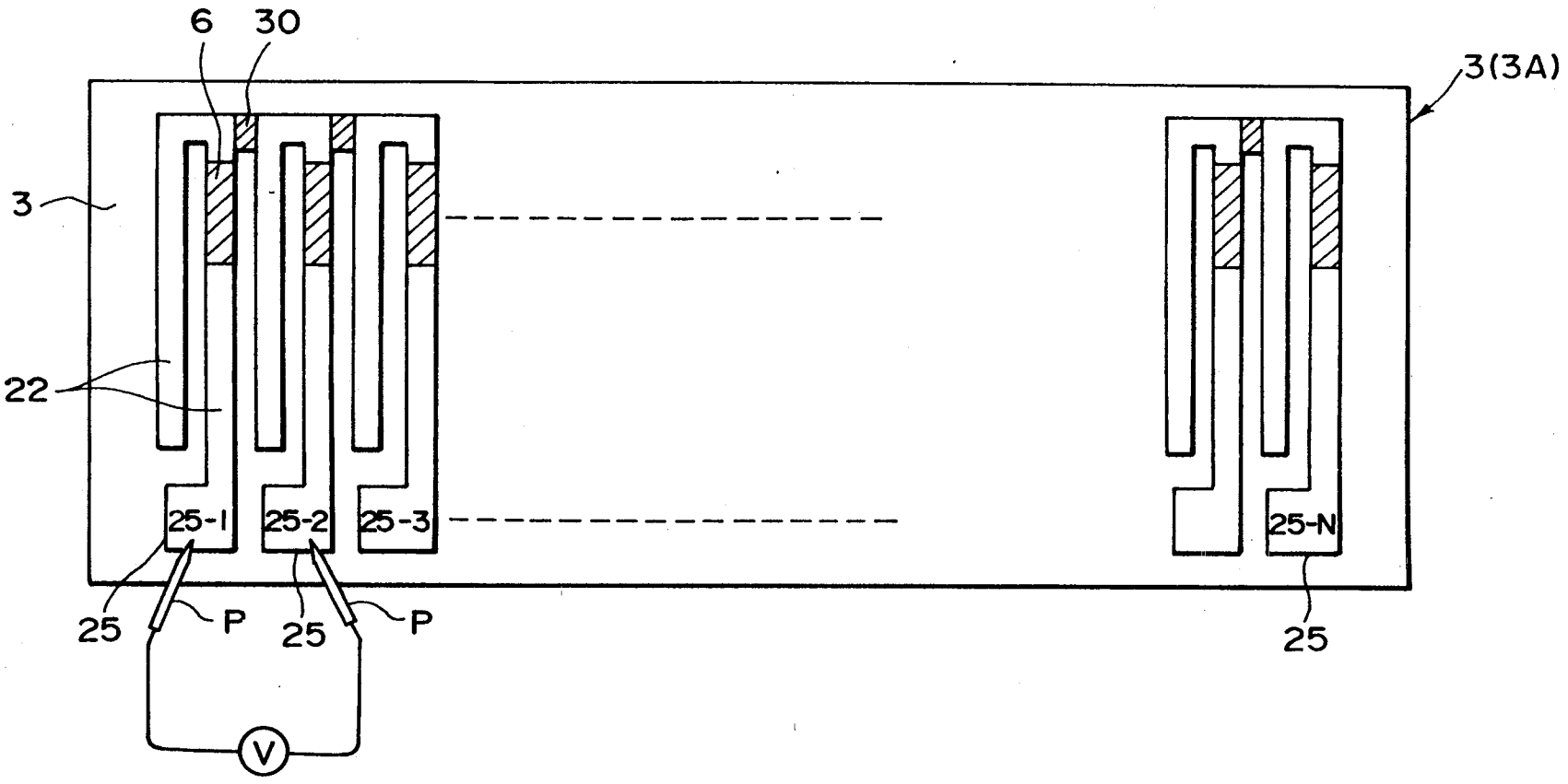
FIG. 11 is a top plan view illustrating the inspection step for the multi-layer circuit substrate.

Referring to FIG. 11, the description will be made as to the substrate 3A during the open/short-circuit inspection or test. At this stage of the manufacturing, if a short-circuit or open-circuit is detected in any wiring line 22 by the inspection, it is still possible to disconnect the line having the short-circuit. The inspection will be described hereinafter. As shown in FIG. 4, the aluminum wiring 22 is to connect the heat generating portion 6 of the heat generating resistor 6 and the driving ICs. At one end thereof, contact pads 25 (25-1—25-n) which are also for the circuit inspection are provided. The inspection or testing resistor 30 contacted to the adjacent lines each have a resistance which does not produce the cross-talk and which permits short-circuit or the like between the adjacent lines. By doing so, the necessity for the provisions of two large contacting pads, is eliminated, and as will be understood from the Figure, the number of pads 25 is reduced to one half, by which the size of the substrate can be reduced correspondingly.

The description will be made as to the inspection for the wiring 22 of the recording head. First, probe pins P are contacted to the pads 25-1-25-N so as to measure the resistances between the pads 25-1 and 25-2, between 25-2 and 25-3, between . . . and between 25-(N-1)-25-N. In FIG. 11, the measurement of the resistance between the pads (25-1 and 25-2) is shown as a representative example. Then, the average of the resistances are determined by a computer. If the measured resistances are deviated from the average not less than ±15 ohm., the line is inspected by the eyes. If the short circuit is confirmed, the short circuit portion is cut by a laser beam or the like. In this manner, even if there is a short circuit, the substrate is not necessarily rejected, but may be used.

Figure 12:
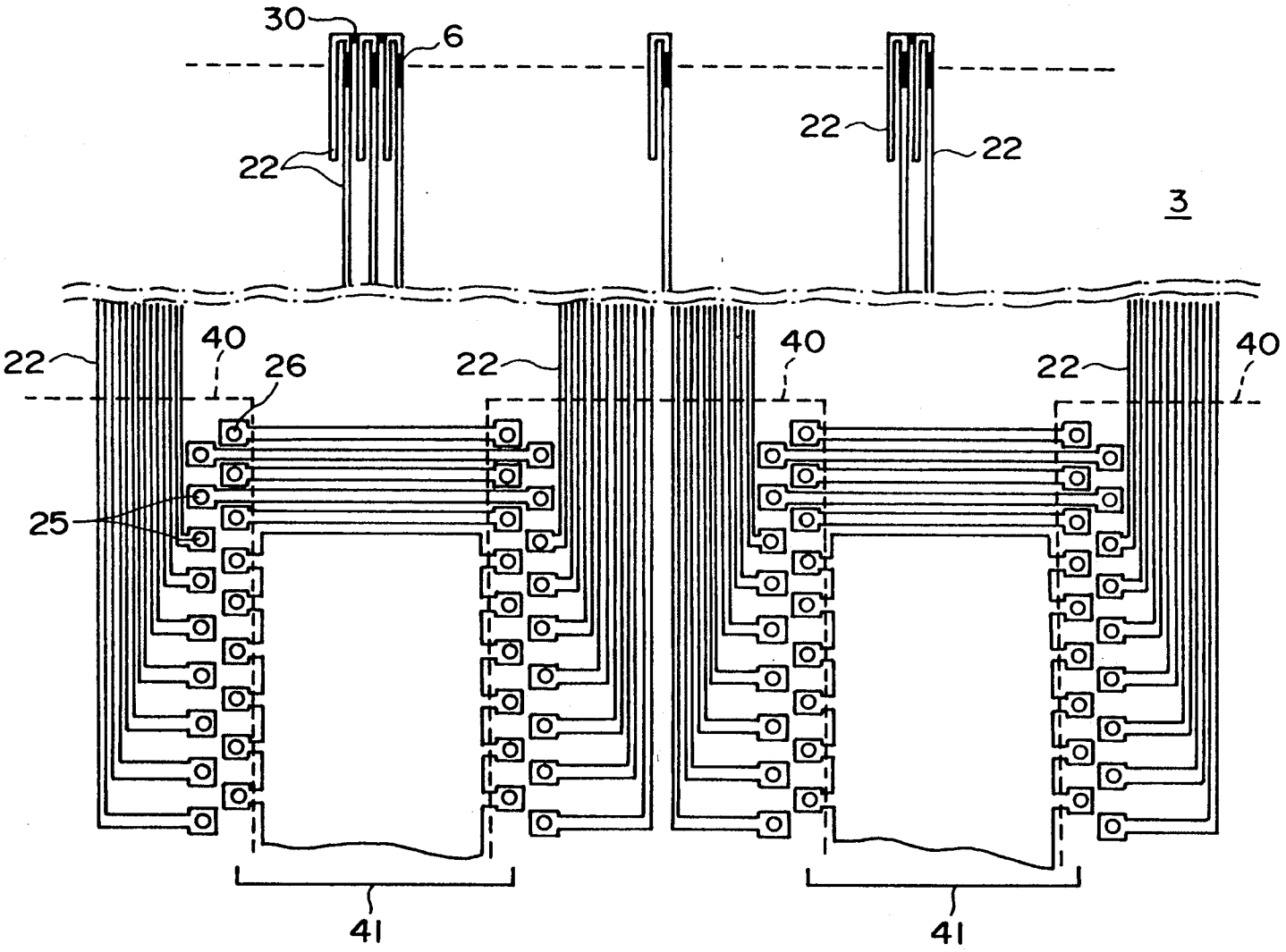
FIG. 12 shows wiring on the ink jet recording supporting plate according to a second embodiment of the present invention.

Referring to FIG. 12, a second embodiment will be described. In this embodiment, the wiring 22 contacted to the heat generating portion 6, pads 25 contacted to the wiring 22 and the heat generating resistor driving IC are contacted by flip chip system by pads 26 which are provided simultaneously on the same supporting plate. FIG. 12 shows the wiring when the short-cut-open-circuit on the substrate is detected. In this Figure, the portion 40 enclosed by broken lines shows a space on the supporting plate 3 for accommodating driving ICs not shown. In the space, the wiring 22 is arranged to be contacted to the heat-generating portions of the heat generating resistors. Designated by a reference 41 are grounding wirings for the driving ICs. The inspection is effected by sequentially contacting a probing pin to the pads 25 for each of the blocks. The evaluation of the results of the measurements are the same as described hereinbefore.

As described with the foregoing embodiments, the inspecting resistor is preferably so disposed below the portion constituting the wall of the ink passage after the ink jet head has been manufactured. The reason is that it is possible that the inspection resistor produces heat, although the quantity is small, during use of the ink jet head. By the above-described arrangement, the produced heat is not directly influential to the ink. On the other hand, the heat produced by the inspection resistors is effective to make uniform the thermal distribution in the direction of the array of the ejection outlets in the ink jet recording head having plural ejection outlets, in some cases. In this sense, the present invention is advantageous particularly for a full-line type ink jet head having plural, preferably 1000 or more, or more preferably 2000 or more ejection outlets.

As described with the foregoing embodiment, the inspecting resistor is preferably disposed to connect the adjacent electrodes adjacent the portion where the electrodes is turned over, from the standpoint of manufacturing and thermal balance. When plural heat generating resistors are supplied with signals to eject the ink through the ejection outlets, the sequential application of the signals is more preferable than the simultaneously application of the signals to the plural resistors from the standpoint of the thermal balance with the inspecting resistor.

The present invention is particularly suitably usable in a bubble jet recording head and recording apparatus developed by Canon Kabushiki Kaisha, Japan. This is because the high density of the picture element and the high resolution of the recording are possible.

The typical structure and the operational principle of are preferably those disclosed in U.S. Pat. Nos. 4,723,129 and 4,740,796. The principle is applicable to a so-called on-demand type recording system and a continuous type recording system. Particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the development and collapse of the the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of recovery means and auxiliary means for the preliminary operation are preferably, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and an additional heating element and means for preliminary ejection not for the recording operation, which can stabilize the recording operation.

As regards the kinds of the recording heads mountable, it may be a single head corresponding to a single color ink, or may be plural heads corresponding to a plurality of ink materials having different recording colors or densities. The present invention is effectively applicable to an apparatus having at least one of a monochromatic mode mainly with black, a multi-color mode with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in a usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material solidifying when it is unused is effective in preventing the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

As described in the foregoing, according to the present invention, a resistor is connected between adjacent circuit lines for power supply to heat generating portions, and therefore, the necessity for large contact pads for the circuit inspection, is eliminated. Correspondingly, the size of the supporting plate can be reduced, and the cost thereof can be also reduced. By measuring the resistance between the adjacent wiring through the inspecting resistor, the short-circuit or open-circuit can be easily detected. This enables repair of the products which have otherwise been rejected. Therefore, the yield can be improved significantly.

While the invention has been described with reference to the structures disclosed herein, it is not confined to the details set forth and this application is intended to cover such modifications or changes as may come within the purposes of the improvements or the scope of the following claims.

What is claimed is:

1. An ink jet head, comprising:

plural ejection outlets for ejecting ink;

a corresponding number of heat generating resistors disposed corresponding to said ejection outlets, said heat generating resistors being driven independently of each other;

electrodes connected to respective heat generating resistors; and testing resistors connecting adjacent electrodes for permitting electrical testing of said electrodes and said heat generating resistors with an external testing means, said resistors having a sufficiently high resistance to prevent cross-talk between adjacent testing resistors.

2. A head according to claim 1, wherein said testing resistors and said heat generating resistors are formed on the same substrate.

3. A head according to claim 1, wherein each electrode has two portions for sandwiching one of said heat generating resistors, wherein one portion is turned over, and one of said testing resistors contacts the adjacent electrodes in the neighborhood of the portion where the electrode is turned over.

4. A head according to claim 1, wherein each electrode has two portions for sandwiching one of said heat generating resistors, wherein a width of an end of one of the portions of the electrode is substantially the same as the width of a corresponding end of the other portion, and a width of the other end of said other portion of the electrode is larger than that of the corresponding other end of the one portion.

5. A head according to claim 1, wherein heat generating portions of said heat generating resistors are arranged in a line.

6. A head according to claim 1, wherein said ejection outlets are arranged to cover an entire width of a recording material.

7. A head according to claim 1, wherein said testing resistor is disposed below a material constituting a wall for defining a passage communicating with one of said ejection outlets.

8. A substrate for an ink jet head including plural ejection outlets for ejecting ink, said substrate comprising:

a corresponding number of heat generating resistors disposed corresponding to said ejection outlets, said heat generating resistors being driven independently of each other;

electrodes connected to respective heat generating resistors; and testing resistors connecting adjacent electrodes for permitting electrical testing of said electrodes and said heat generating resistors with an external testing means, said resistors having a sufficiently high resistance to prevent cross-talk between adjacent testing resistors.

9. A substrate according to claim 8, wherein said testing resistors and said heat generating resistors are formed on the same substrate.

10. A substrate according to claim 8, wherein each electrode has two portions for sandwiching one of said heat generating resistors, wherein one portion is turned over, and one of said testing resistors contacts the adjacent electrodes in the neighborhood of the portion where the electrode is turned over.

11. A substrate according to claim 8, where each electrode has two portions for sandwiching one of said heat generating resistors, wherein a width of an end of one of the portions of the electrode is substantially the same as the width of a corresponding end of the other portion, and a width of the other end of said other portion of the electrode is larger than that of the corresponding other end of the one portion.

12. A substrate according to claim 8, wherein heat generating portions of said heat generating resistors are arranged in a line.

13. An ink jet apparatus, comprising:

an ink jet head comprising plural ejection outlets for ejecting ink; a corresponding number of heat generating resistors disposed corresponding to said ejection outlets, said heat generating resistors being driven independently of each other; electrodes connected to respective heat generating resistors; testing resistors connecting adjacent electrodes for permitting electrical testing of said electrodes and said heat generating resistors with an external testing means, said resistors having a sufficiently high resistance to prevent cross-talk between adjacent testing resistor; and feeding means for feeding a recording material onto which said ejection outlets eject the ink.

14. An apparatus according to claim 13, wherein signals are sequentially applied to said heat generating resistors through said electrodes.

15. A method of testing an ink jet head, said method comprising the steps of:

providing an ink jet head comprising plural ejection outlets for ejecting ink; a corresponding number of heat generating resistors disposed corresponding to said ejection outlets, said heat generating resistors being driven independently of each other; electrodes connected to respective heat generating resistors; and testing resistors connecting adjacent electrodes for permitting electrical testing of said electrodes and said heat generating resistors with an external testing means, said testing resistors having a sufficiently high resistance to prevent cross-talk between adjacent testing resistors; and detecting electrical resistance between electrodes connected by said testing resistors with the external testing means.

16. A method according to claim 15, wherein after said detecting step, the ink jet recording head is repaired depending on a result of said detecting step.

17. A method according to claim 16, wherein in said repairing step, short-circuit portions of the circuit are cut with a laser beam.

18. A method of manufacturing an ink jet recording head, said method comprising the steps of:

providing an ink jet head comprising plural ejection outlets for ejecting ink; a corresponding number of heat generating resistors disposed corresponding to said ejection outlets, said heat generating resistors being driven independently of each other; electrodes connected to respective heat generating resistors; and testing resistors connecting adjacent electrodes for permitting electrical testing of said electrodes and said heat generating resistors with an external testing means, said testing resistors having a sufficiently high resistance to prevent cross-talk between adjacent testing resistors;

detecting electrical resistance between electrodes connected by said testing resistors with the external testing means; and forming ink passages on said ink jet recording head.

19. A method according to claim 18, wherein said passage is formed after said detecting step using said testing resistors and after a repairing operation depending on a result of said detecting step.

20. A method according to claim 19, wherein in the repairing operation, any short-circuit portions are cut using a laser beam.

* * * * *

UNITED STATES PATENT AND TRADEMARK OFFICE

CERTIFICATE OF CORRECTION

PATENT NO. : 5,164,747

DATED : November 17, 1992

INVENTOR(S) : TORACHIKA OSADA ET AL.

It is certified that error appears in the above-identified patent and that said Letters Patent is hereby corrected as shown below:

On the title page;

AT [56] REFERENCES CITED

"3,345,262 8/1982 Shirato et al." should read
--4,345,262 8/1982 Shirato et al.--.

AT [57] ABSTRACT

Line 1, "inspection" should read --inspection resistors--.
Line 3, "short-circuit" should read --short-circuits--.

COLUMN 1

Line 25, "an" should be deleted.

COLUMN 3

Line 29 should read
--FIGS. 6A, 6B; 7A, 7B, 7C; 8A, 8B, 8C; 9A, 9B,--.
Line 30, "9C'; and 10A', and 10B' and 10C'" should read
--9C; and 10A, and 10B and 10C--.
Line 58, "14" should read --12--.

COLUMN 4

Line 27, "enlarges" should read --enlarged--.
Line 31, "generatig" should read --generating--.
Line 46, "head." should read --head will be described.--.

COLUMN 6

Line 4, "simultaneously" should read --simultaneous--.
Line 13, "of" should be deleted.

UNITED STATES PATENT AND TRADEMARK OFFICE

CERTIFICATE OF CORRECTION

PATENT NO. : 5,164,747

DATED : November 17, 1992

INVENTOR(S) : TORACHIKA OSADA ET AL.

It is certified that error appears in the above-identified patent and that said Letters Patent is hereby corrected as shown below:

COLUMN 7

Line 4, "preferably," should read --preferable--.
Line 8, "sucking" should read --suction--.
Line 52, "one" should read --system--.
Line 64, "inspection," should read --inspection--.

COLUMN 9

Line 33, "resistor;" should read --resistors;--.

Signed and Sealed this

Fifteenth Day of December, 1998

Bruce Lehman

*Attest:*

BRUCE LEHMAN

*Attesting Officer*

*Commissioner of Patents and Trademarks*